US005873792A

United States Patent [19]

Chen

[11] Patent Number: 5,873,792

[45] Date of Patent: Feb. 23, 1999

[54] GOLF DRIVER CLUB HEAD

[75] Inventor: Kuang-Wei Chen, Kaohsiung Hsion, Taiwan

[73] Assignee: Chien Ting Precision Casting Co., Ltd., Ping Tung, Taiwan

[21] Appl. No.: 83,025

[22] Filed: May 22, 1998

Related U.S. Application Data

[63] Continuation-in-part of Ser. No. 834,308, Apr. 15, 1997, abandoned.

[51] Int. Cl.[6] ..... A63B 53/00

[52] U.S. Cl. ..... 473/314

[58] Field of Search ..... 473/313, 314, 473/325, 324, 329, 330, 349, 289, 290, 292

[56] References Cited

U.S. PATENT DOCUMENTS

| | | | |
|---|---|---|---|
| 2,926,913 | 1/1960 | Stecher | 473/314 |
| 3,166,320 | 1/1965 | Onions | 473/314 |
| 3,176,987 | 4/1965 | Johnston | 473/313 |
| 4,157,830 | 6/1979 | Taylor | 473/314 |
| 4,896,885 | 1/1990 | Kajita | 473/314 |

OTHER PUBLICATIONS

"Golf World", magazine, Jun. 11, 1976 issue, p. 14, advertisement for 'Irons/Woods' Jun. 1976.

*Primary Examiner*—Sebastiano Passaniti
*Attorney, Agent, or Firm*—Rosenberg, Klein & Bilker

[57] ABSTRACT

A golf driver club head is provided that has a neck with a hole for receiving a lower end of a golf club shaft therein. The neck also extends obliquely from a heel portion of the head toward the striking face. The impact point on the face of the head forms a narrower angle with respect to the center line of the shaft. By that arrangement, the golf driver club head can hit a ball to follow a straight trajectory.

1 Claim, 2 Drawing Sheets

GOLF DRIVER CLUB HEAD

CROSS-REFERENCE TO RELATED APPLICATIONS

This Application is a Continuation-in-Part Application of application Ser. No. 08/834,308, filed 15 Apr. 1997, abandoned, entitled GOLF CLUB HEAD.

BACKGROUND OF THE INVENTION

This invention relates to a golf driver club head. Particularly, this invention is directed to a golf driver club head having a neck with a hole for a lower end of a club shaft to fit firmly therein. The neck extends up obliquely rearward by a predetermined distance so that a ball hit by the driver head flies along a straight trajectory, and flies further than a ball hit by a conventional golf club head.

PRIOR ART

A known conventional golf driver club head 10, as shown in FIG. 4, includes a face 101 for hitting a ball, and displaced from the face by a distance $H_1$. The angle θ1 formed between the face line and the shaft center line is greater than a corresponding angle in the present invention. Consequently, the known conventional golf driver club head is more likely to cause a ball to fly along an angularly displaced trajectory instead of a straight trajectory.

SUMMARY OF THE INVENTION

The purpose of the invention is to offer a golf driver club head able to hit a ball to fly along a straight trajectory, instead of an angularly displaced trajectory which occurs with the known conventional golf driver club head as a result of its structure.

A main feature of the invention is defined by a relationship between a face of the driver club head and a shaft mounting, which provides a narrower angle between the shaft center line and a face line than that of the known conventional driver club head.

BRIEF DESCRIPTION OF THE DRAWINGS

This invention will be better understood by referring to the accompanying drawings, wherein.

DESCRIPTION OF THE PREFERRED EMBODIMENT

Figure 1:
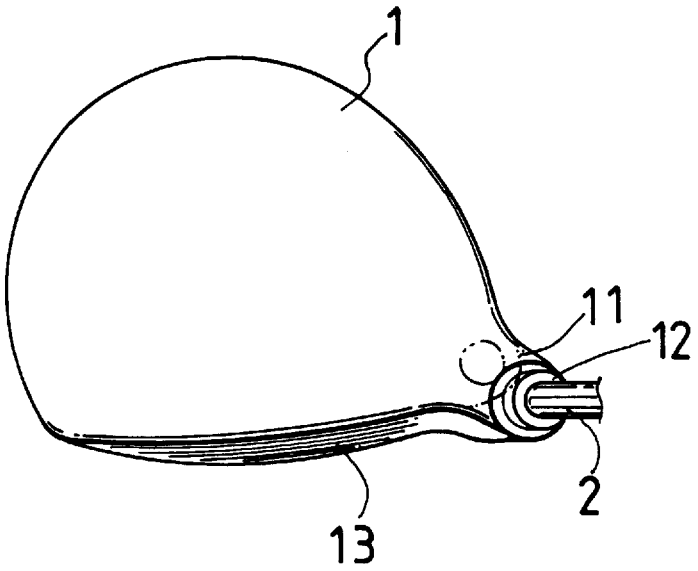
FIG. 1 is an upper view of a preferred embodiment of a golf club head in the present invention.
Figure 2:
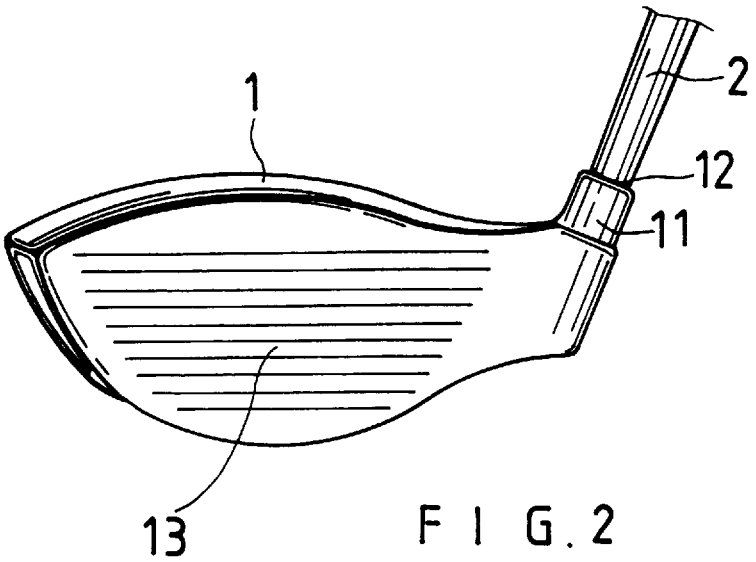
FIG. 2 is a front view of the preferred embodiment of a golf club head in the present invention.

A preferred embodiment of a golf driver club head 1 of the present invention, as shown in FIG. 1, includes a neck 11 extending obliquely from the heel portion of the head 1 and toward the face 13 by a predetermined distance, thereby locating a center line of the shaft 2 closer to an impact point of the striking face 13. A shaft hole 12 is formed in the neck 11 for a lower end of the shaft 2 of the golf club to fit firmly therein and extend to a bottom of the head 1, for stabilizing the shaft 2 in the club head 1.

Figure 4:
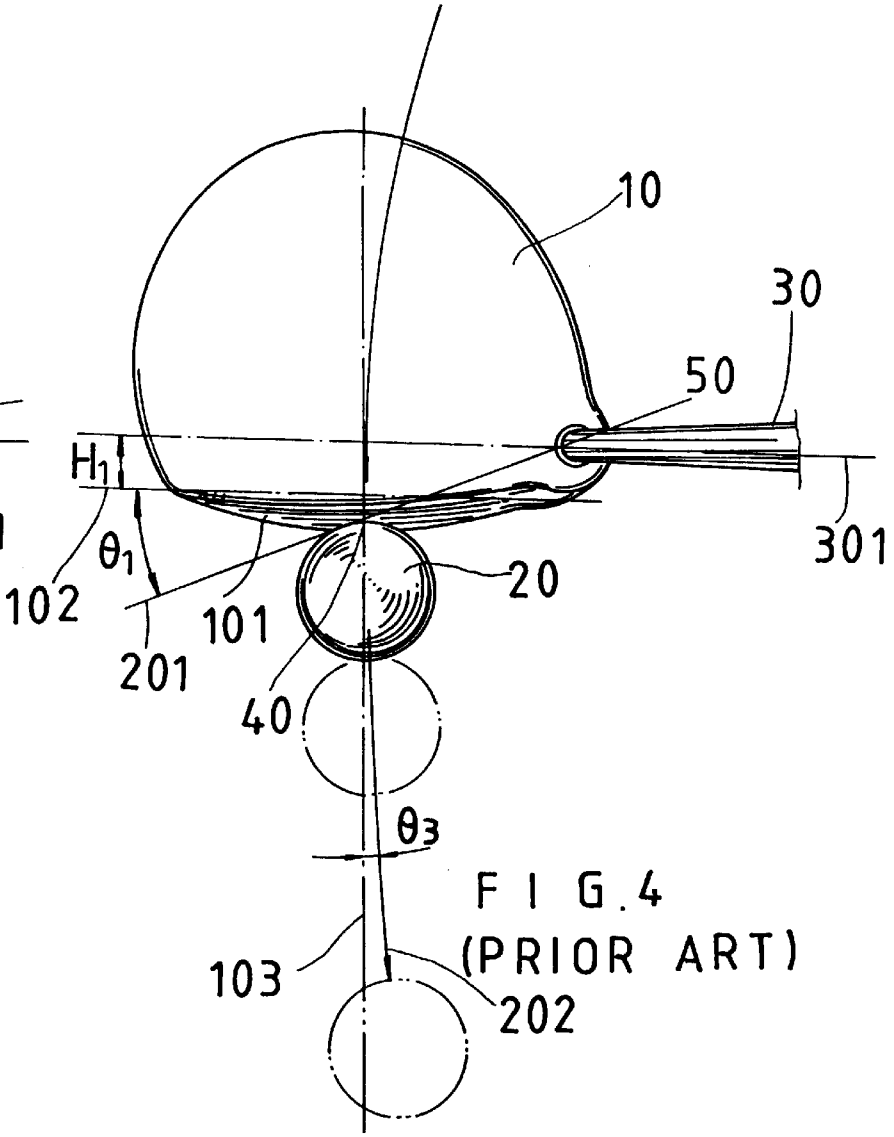
FIG. 4 (PRIOR ART)
FIG. 4 is an upper view of a known conventional golf club head and the direction of a ball hit by it.

Referring to the conventional golf driver club head 10 shown in FIG. 4, such includes a striking face 101, a striking face line 102, a shaft 30 and a center line of the shaft 301. The striking face line 102 of the striking face 101 and the center line of the shaft 301 are separated by a distance H1. Between a centrally disposed impact point 40 and a force point 50 extends an inclined line 201 at an angle θ1 relative to the central line of the shaft 301. The angle θ1 is typically within the range of 16°–20°.

Figure 3:
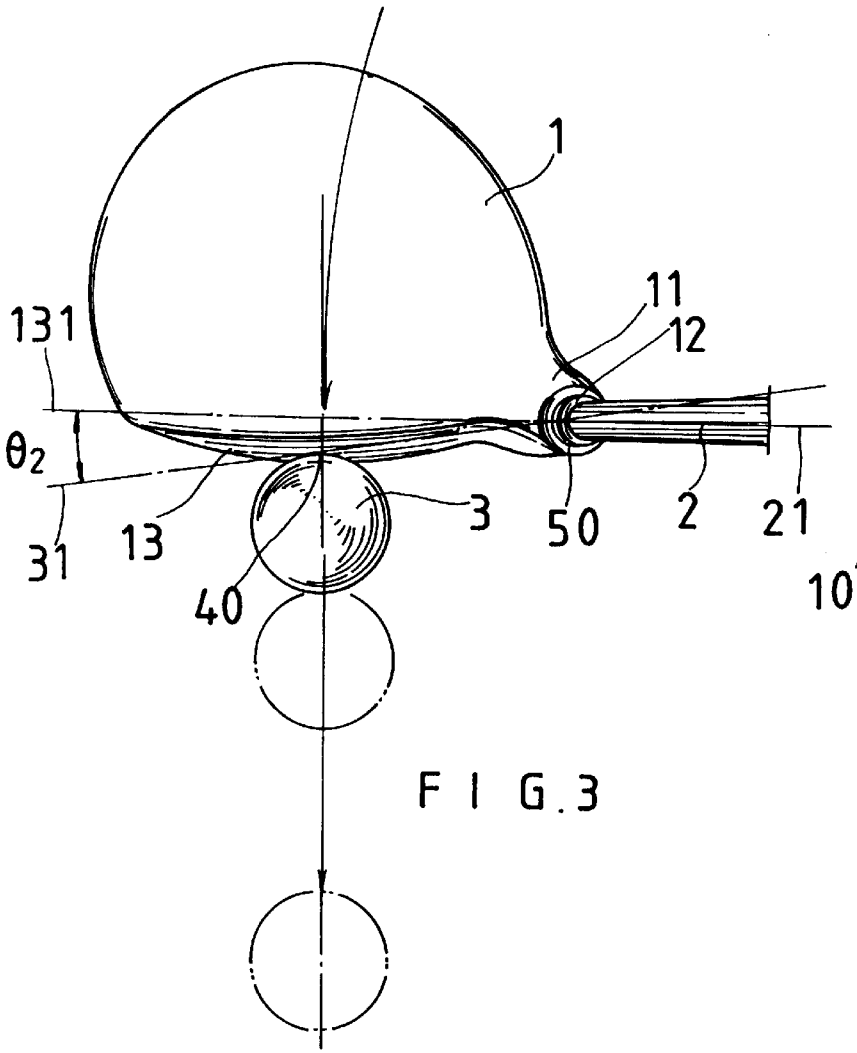
FIG. 3 is an upper view of the preferred embodiment of a golf club head and the direction of a ball hit by it, in the present invention.

The driver club head of the invention has a face 13 where an inclined line 31 extends between the impact point 40 that is disposed centrally on face 13, and the force point 50, at the coupling point of the shaft 2 to the head, to form an angle θ2 with respect to the central line 21 of the shaft 2, shown in FIG. 3.

The angle θ2 is narrower than the angle θ1, shown in FIG. 4, due to the distance H1 of the known conventional golf club head 10. The angle θ2 is within the range of 7°–12°. In the conventional golf club head 10 of FIG. 4, the ball 20 is hit at angle θ3 with respect to the orthogonal reference line 103, causing the ball 20 to fly along a trajectory that is not straight, not coaxial with reference line 103.

Referring to FIG. 3, a center line 21 of the shaft 2 and a striking face line 131 are very close to each other, due to the neck 11 being extended obliquely from the heel portion of the head 1, so that the angle θ2 is narrow, within the range of 7°–12°. That arrangement makes the ball 3 fly straight. When a beginning golfer hits a golf ball with the golf driver club head 1 of the invention, he/she holds the golf club shaft 2 with the striking face 13 of the club head 1 resting behind a ball, with his/her waist, hands and the striking face 13 of the driver club head 1 all being kept in line with the ball 3. Then, the golfer swings to hit the ball 3, which then follows a straight trajectory, and is hit further than a golf ball hit by a conventional golf driver club head, which conventional golf driver club head is generally likely to hit a ball to follow a trajectory that is biased to one side, namely a slice.

While the preferred embodiment of the invention has been described above, it will be recognized and understood that various modifications may be made therein and the appended claims are intended to cover all such modifications which may fall within the spirit and scope of the invention.

What is claimed is:

1. A golf driver club head comprising a striking face having a centrally disposed impact point and an integrally formed neck extending obliquely from a heel portion of said club head toward a plane containing said striking face, wherein a force point is defined at a coupling point of the neck; said coupling point for attachment to a club shaft; a striking face reference line contained within a plane that extends longitudinally and substantially parallel to the striking face; said neck being located on said head for positioning a center line of a golf club shaft to substantially coincide with said striking face reference line; said impact point and said force point defining a line therebetween extending at an angle within a range of approximately 7–12 degrees with respect to said striking face reference line, whereby a narrow angle is provided between a center line of a shaft and said striking face reference line to propel a ball hit by said striking face at said impact point along a substantially straight path.

* * * * *